US008556409B2

(12) United States Patent
Yearout et al.

(10) Patent No.: US 8,556,409 B2
(45) Date of Patent: Oct. 15, 2013

(54) PRINTERS AND DUPLEXERS FOR PRINTERS

(75) Inventors: Russell P Yearout, Brush Prairie, WA (US); Daniel Fredrickson, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 396 days.

(21) Appl. No.: 12/906,852

(22) Filed: Oct. 18, 2010

(65) Prior Publication Data

US 2012/0092430 A1 Apr. 19, 2012

(51) Int. Cl.

| | |
|---|---|
| ***B41J 2/01*** | (2006.01) |
| ***B41J 2/165*** | (2006.01) |
| ***B41J 2/155*** | (2006.01) |

(52) U.S. Cl.

USPC ..... 347/104; 347/23; 347/42

(58) Field of Classification Search

None

See application file for complete search history.

(56) References Cited

U.S. PATENT DOCUMENTS

| | | | | |
|---|---|---|---|---|
| 5,331,339 | A * | 7/1994 | Takahashi | 347/89 |
| 6,325,503 | B1 * | 12/2001 | McCue et al. | 347/101 |
| 6,466,761 | B1 | 10/2002 | Rene et al. | |
| 7,682,014 | B2 * | 3/2010 | Snyder et al. | 347/102 |
| 2006/0232615 | A1 * | 10/2006 | Berg et al. | 347/1 |
| 2007/0273725 | A1 | 11/2007 | Furukawa et al. | |
| 2008/0055377 | A1 * | 3/2008 | Jones et al. | 347/88 |
| 2008/0198197 | A1 | 8/2008 | Morris et al. | |
| 2008/0238993 | A1 | 10/2008 | Gomez et al. | |
| 2009/0219337 | A1 * | 9/2009 | Harada et al. | 347/36 |
| 2009/0256884 | A1 * | 10/2009 | Aoki | 347/23 |

* cited by examiner

*Primary Examiner* — Stephen Meier
*Assistant Examiner* — Alexander C Witkowski

(57) ABSTRACT

Printers and duplexers are described herein. An example duplexer for a printer includes a print substrate path to guide a print substrate and a chamber to collect a fluid.

20 Claims, 7 Drawing Sheets

PRINTERS AND DUPLEXERS FOR PRINTERS

BACKGROUND

Some printers are only capable of simplex (i.e., one-sided) printing on a print substrate. On the other hand, some printers are capable of duplex (i.e., two-sided) printing.

DETAILED DESCRIPTION

During manufacturing, portions of some printers may be partially or completely filled with a shipping fluid to prevent sensitive parts from drying and/or being damaged. For example, a fluid that resists drying may be used to store a print bar and/or print heads so that these parts are not impaired or even rendered useless if they spend a significant amount of time in shipping channels (e.g., stored in a warehouse for an extended period). When the parts containing the shipping fluid are installed, the shipping fluid is purged so that the parts may be used.

In order to capture the purged fluid, known printers have included a separate, standalone spittoon. Such traditional spittoons are not integrated to the duplexer, are not user replaceable, and typically have limited storage capacity due to space constraints within the printer. Further, in the event of a paper jam in a printer employing a traditional spittoon, it is sometimes necessary to remove both the duplexer and the spittoon to clear the jam; thereby causing user inconvenience, increasing operation complexity and increasing the likelihood that a user may improperly reinstall the parts after jam clearing. Thus, the use of a traditional spittoon results in printers having additional parts, increased size and increased manufacturing costs.

Example printers and duplexers disclosed herein overcome these and/or other problems by integrating a spittoon into a duplexer. Integrating the spittoon into the duplexer eliminates the need for a separate spittoon, thereby reducing part counts, size requirements, and/or manufacturing costs for a printer including the integrated duplexer-spittoon. Example duplexers include a chamber to collect shipping fluid that is purged from the printer and to collect waste ink ejected from a print bar during cleaning operations. Advantageously, the duplexer may be removed from the printer to, for example, clear paper jams and/or to clean, empty, and/or replace the chamber when it is full. By integrating the spittoon in the duplexer, the spittoon may be larger (e.g., have more volume) to store more waste ink, shipping fluid, and/or other waste substances than traditional standalone spittoons, thereby extending a useful life of the spittoon and reducing operating costs for a user of the printer.

Figure 1:
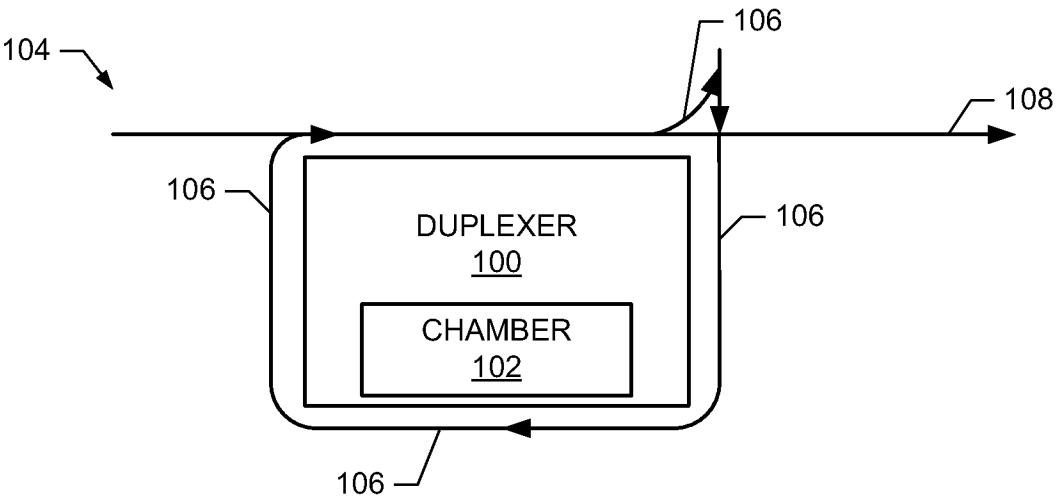
FIG. 1 is a block diagram of an example duplexer having an integrated spittoon in accordance with the teachings herein.

FIG. 1 is a block diagram of an example duplexer 100 for a printer. The example duplexer 100 includes a chamber 102 and defines a print substrate path 104. The illustrated print substrate path 104 includes a duplex path 106 and an output path 108. The example duplexer 100 may guide a print substrate along the substrate path 104 to the duplex path 106 and/or to the output path 108. The chamber 102 functions as a spittoon to collect and/or store fluids within the duplexer 100. Example fluids that may be collected in the chamber 102 include shipping fluids, waste ink from print cleaning processes, and/or other fluids associated with printers. As used herein, a shipping fluid refers to any fluid used to maintain a printer component in operable condition while printer component moves through shipping or transit channels. For example, print heads (e.g., print bar heads, scanning inkjet heads) may be filled with a shipping fluid to prevent the print heads and/or nozzles from drying and/or clogging.

The duplexer 100 of the illustrated example may be installed and/or removed from a printer to, for example, facilitate the clearing of paper jams that may occur during printing. In some examples, a user of the printer may easily remove the duplexer 100 to obtain access to a blocked substrate path. Because the chamber 102 is internal to the duplexer 100, there is no need to remove a separate spittoon to address such paper jams.

Figure 2:
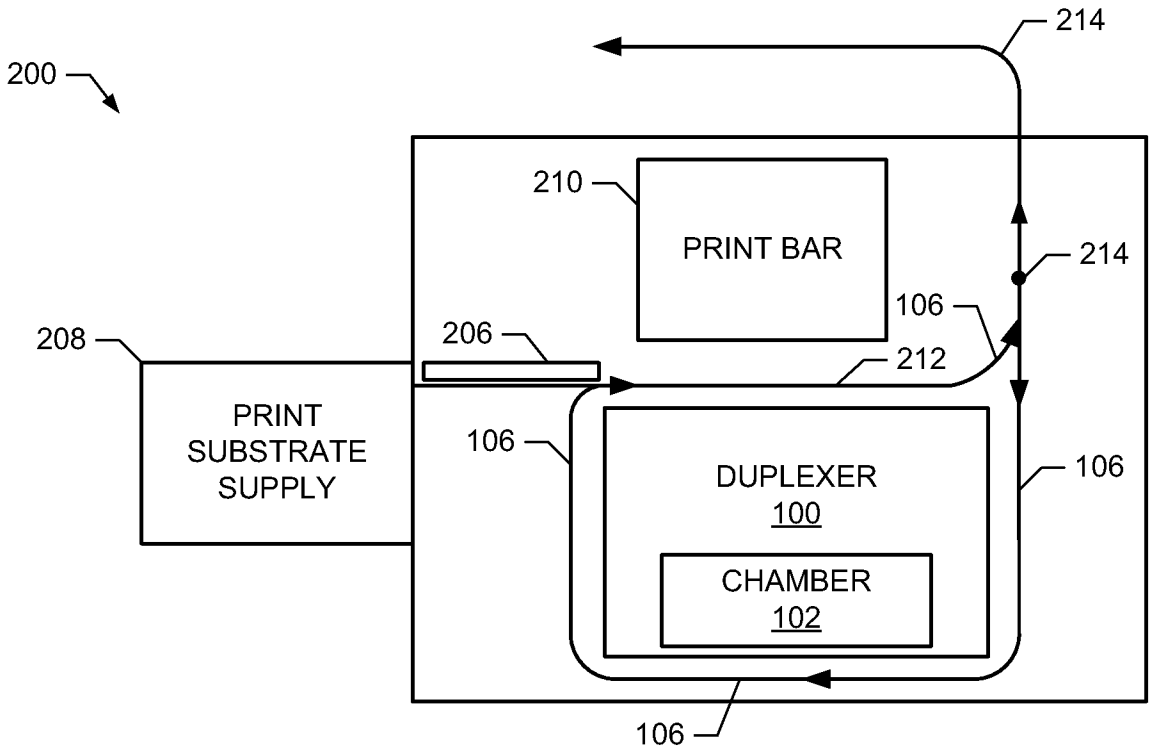
FIG. 2 is a block diagram of an example printer including the duplexer of FIG. 1.

FIG. 2 is a block diagram of an example image forming apparatus 200 (e.g., a printer) including the duplexer 100 with the integrated chamber or spittoon 102. The example printer 200 of FIG. 2 receives a print substrate 206 from a print substrate supply 208 and generates an image on one or both sides of the print substrate 206 using a print bar 210. To generate the image(s) on the print substrate 206, the print bar 210 ejects ink onto a side of the print substrate 206 facing the print bar 210 according to a print pattern as the print substrate 206 travels along a substrate path 212. A printed image, as used herein, refers to any graphic(s), alphanumeric character (s), glyph(s), and/or any other pattern(s) or mark(s) that may be formed by applying ink to a substrate.

In simplex or one-sided printing, the print substrate 206 exits the printer 200 via an output substrate path 214 after the print bar 210 generates the image on the first side of the print substrate 206. The second side of the substrate 206 is not printed in this process. On the other hand, in duplex or two-sided printing, the duplexer 100 causes the print substrate 206 to follow a duplex substrate path 106. In particular, after a first pass along the substrate path 212 and print bar 210, the duplexer 100 diverts the print substrate 206 from the substrate path 212 as in simplex printing. However, at a location 216 along the substrate path 212, the duplexer 100 reverses the direction of the print substrate 206 to direct the print substrate 206 to the duplex substrate path 106 instead of the output substrate path 214. The example duplexer 100 illustrated in FIG. 2 uses a passive diverter. However, an active diverter may be used to direct the print substrate 206 to the duplex substrate path 106 and/or to the output substrate path 214.

By diverting the print substrate 206 to the duplex substrate path 106, the duplexer 100 flips the print substrate 206 to cause the second side of the print substrate 206 to face the print bar 210 during a second pass along the substrate path 212. After flipping, the duplexer 100 directs the flipped print substrate 206 along the duplex substrate path 106 (e.g., around the duplexer 100) and back onto the substrate path 212 for the print bar 210 to generate an image on the second side of the print substrate 206. After performing duplex printing, the duplexer 202 then permits the print substrate 206 to exit the print stage the output substrate path 214.

As in other image forming apparatus, the example printer 200 of FIG. 2 periodically or aperiodically performs one or more cleaning operations on the print bar 210 to maintain subjective print quality and/or increase the useful life of the print bar 210. One such cleaning operation is spitting, in which the print bar ejects excess ink to reapply moisture to ink nozzles and prevent and/or clear clogged nozzles. This waste ink is collected into the chamber 102.

Figure 3:
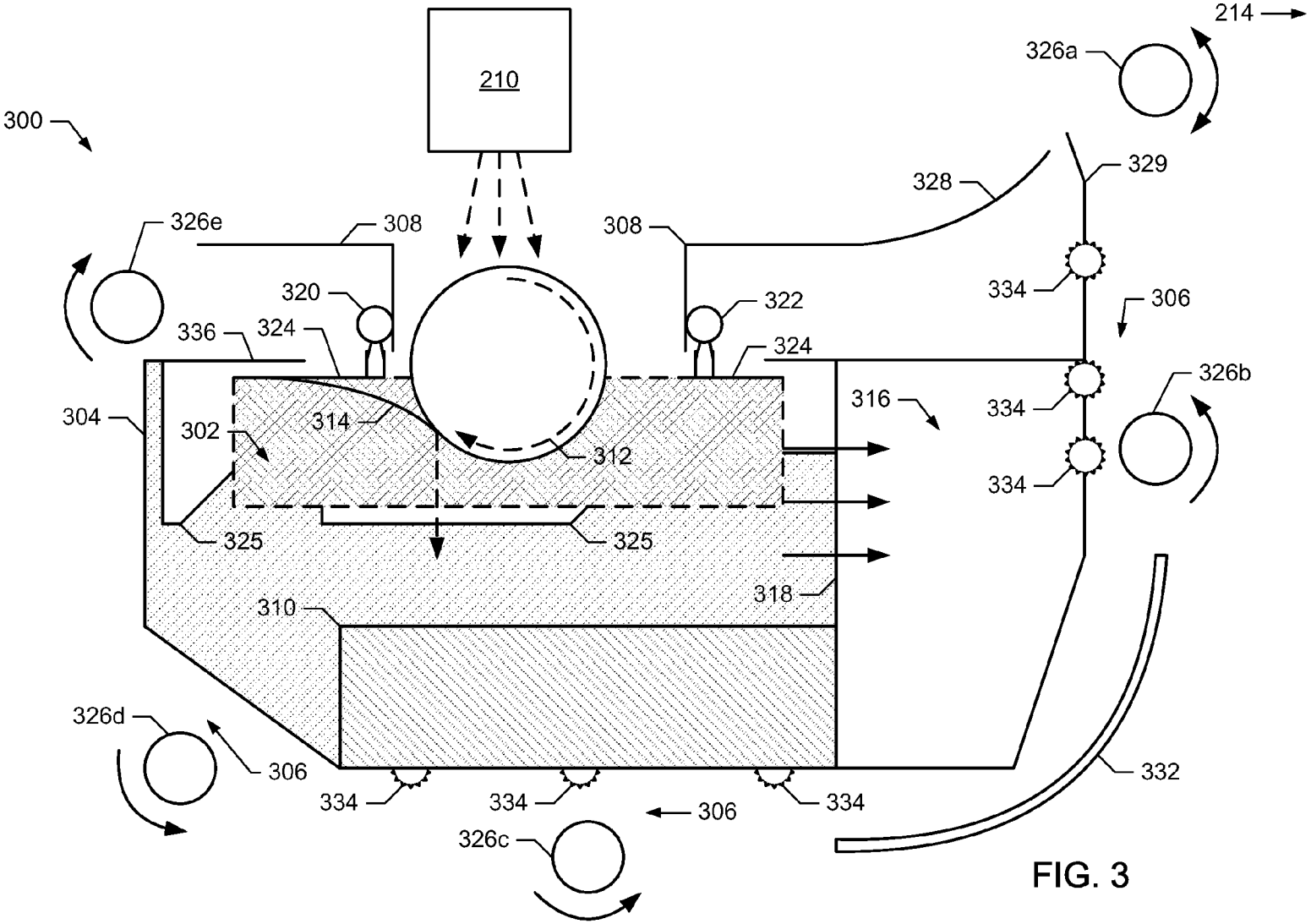
FIG. 3 is a schematic diagram of another example duplexer having an integrated spittoon in accordance with the teachings herein and shown in an installed position.

FIG. 3 is a schematic diagram of an example duplexer 300 having an integrated waste substance chamber 302. The example duplexer 300 may be used to implement the duplexer 100 of FIGS. 1 and 2. The example duplexer 300 of FIG. 3 includes a housing 304 defining a duplex printing path 306. A print substrate (e.g., the print substrate 206 of FIG. 2) travels along the duplex printing path 306 to enable printing on a second side of the print substrate as explained above in connection with FIG. 2. A platen 308 guides the print substrate adjacent the print bar 210.

Figure 4:
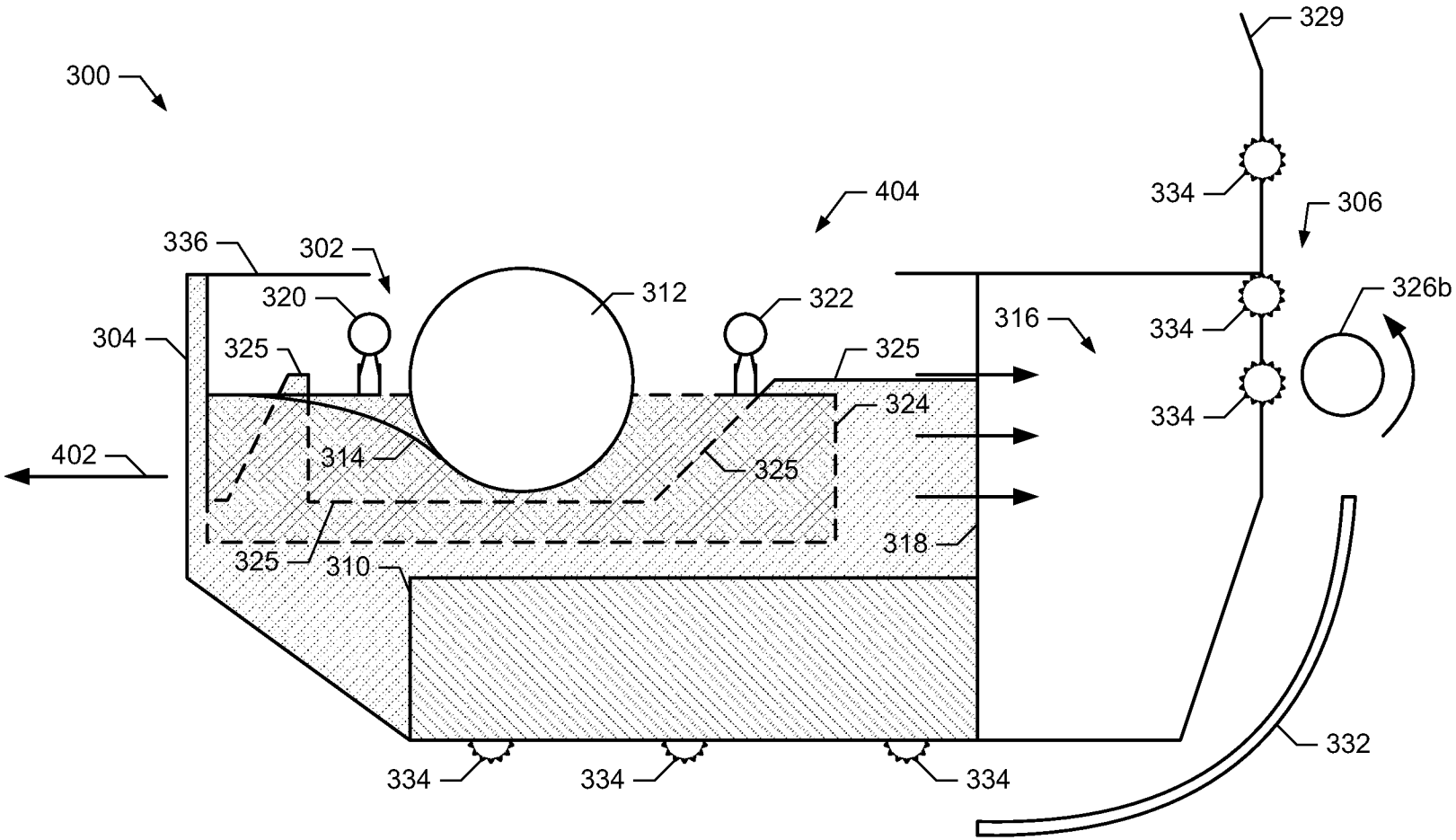
FIG. 4 is a schematic diagram of the example duplexer of FIG. 3 shown uninstalled from a printer.
Figure 5:
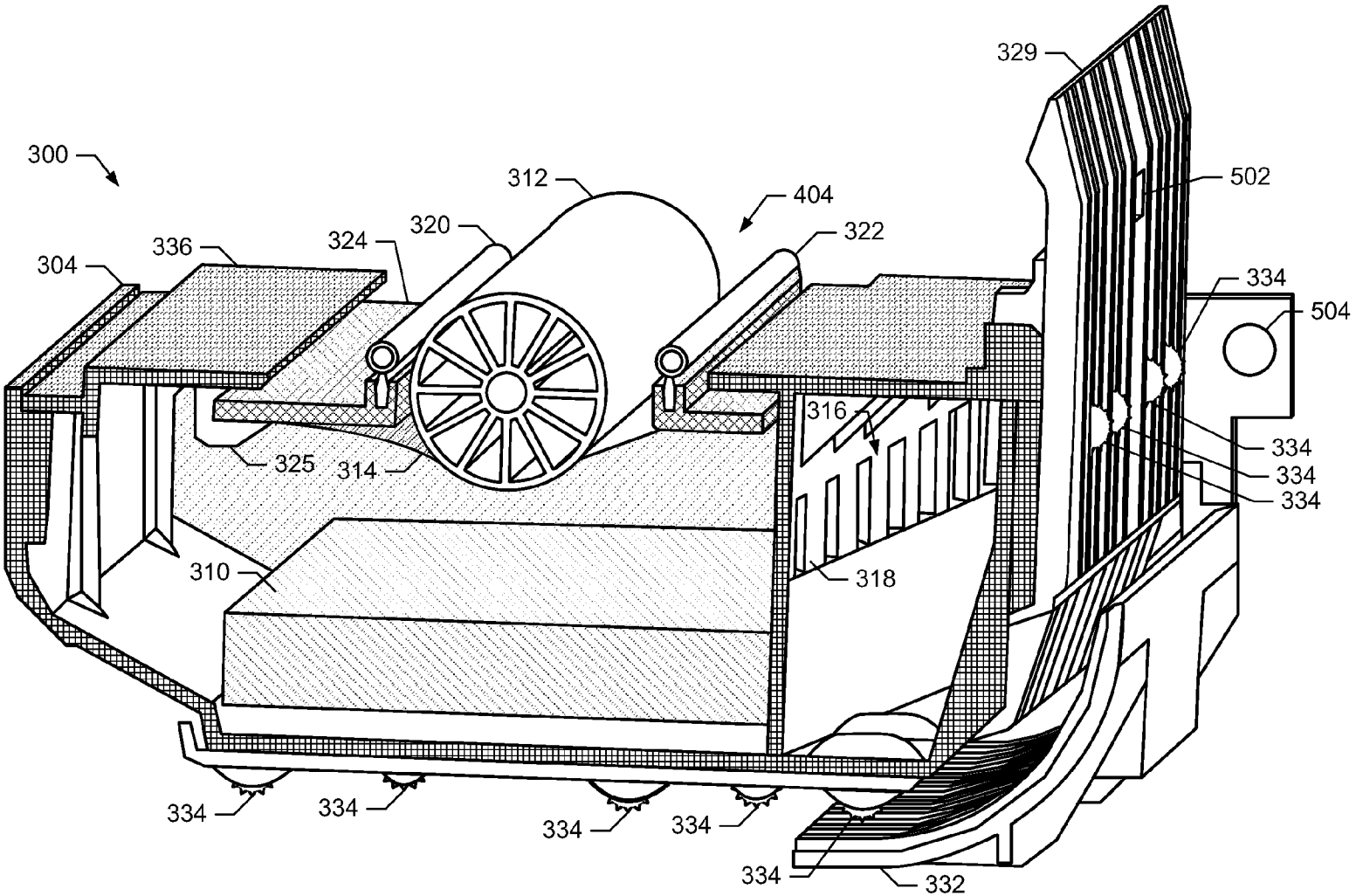
FIG. 5 is a cross-sectioned view of the example duplexer of FIGS. 3 and 4.

The waste substance chamber 302 is integrated within and defined by the housing 304 and/or one or more walls or partitions internal to the housing 304. The example waste substance chamber 302 of FIG. 3 includes an absorber 310 to absorb shipping fluid and/or waste ink. The absorber 310 may be constructed using absorbent foam or any other desired absorbent material. While the absorber 310 illustrated in FIGS. 3-5 is constructed using a rectangular foam pad, the absorber 310 may be any other shape and/or size. In the illustrated example, the absorber 310 may be removed from the waste substance chamber 302. Removing the absorber 310 facilitates refreshing the duplexer 300 by enabling replacement of the absorber 310 and, thus, a re-use of the duplexer 300.

The example duplexer 300 of FIG. 3 further includes a waste ink roller 312 to collect waste ink ejected from the print bar 210. The waste ink roller 312 of the illustrated example is provided with a scraper 314 to remove ink from the waste ink roller 312 by scraping the waste ink roller 312 as it rotates (e.g., clockwise in the view of FIG. 3). By scraping the waste ink roller 312, the scraper 314 reduces and/or prevents substantial build-up of waste ink on the roller 312. In the absence of such scraping, waste build up can potentially interfere with print quality. The example waste ink roller 312 may be rotated by, for example, an actuator such as a motor. The scraper 314 causes the waste ink to drop from the waste ink roller 312 into the waste substance chamber 302 and/or onto the absorber 310.

During cleaning operations, the example print bar 210 of the illustrated example generates ink aerosol in addition to waste ink droplets. Ink aerosol may be undesirable, as it can interfere with the operation of the print bar 210 and/or contaminate other areas of a printer. To reduce an amount of ink aerosol escaping to other areas of the printer, the duplexer 300 of the illustrated example further includes an aerosol collection chamber 316. In the illustrated example, a permeable wall 318 defines the example waste substance chamber 302 and separates the waste substance chamber 302 from the aerosol collection chamber 316. In some examples, the wall 318 has holes to permit gas (e.g., aerosol) flow between the waste substance chamber 302 and the aerosol collection chamber 316. As illustrated in FIG. 4 below, the aerosol collection chamber 316 of the illustrated example includes an output port to be coupled to an aerosol filter. In some examples, the aerosol filter includes a vacuum to pull air and aerosol particles suspended in the air from the waste substance chamber 302 to the aerosol filter through the permeable wall 318 and the aerosol collection chamber 316.

In addition to the aerosol collection chamber 316, the example duplexer 300 of FIG. 3 includes bulb seals 320 and 322. The bulb seals 320 and 322 of the illustrated example deform to seal between the platen 308 and a spit roller sled 324 to reduce or prevent the ink aerosol from escaping and contaminating other portions of a printer 200. The spit roller sled 324 of the illustrated example supports the roller 312, the scraper 314, and the bulb seals 320 and 322. The spit roller sled 324 of FIG. 3 is movable relative to the housing 304. Specifically, when the duplexer 300 is correctly installed in the printer 200, the spit roller sled 324 moves upward along a track 325 in the housing 304 to engage the platen 308. When the duplexer 300 is removed from the printer 200, the spit roller sled 324 retracts along the track 325 into the waste substance chamber 302 as illustrated in FIG. 4 and described in more detail below.

During cleaning operations, the print bar 210 ejects waste ink onto the waste ink roller 312. The waste ink roller 312 rotates to release the waste ink into the waste substance chamber 302. The scraper 314 scrapes waste ink from the waste ink roller 312 as the waste ink roller rotates.

The example duplexer 300 of FIG. 3 is installed in the printer 200 in such a position as to define a duplex printing path 306 (e.g., the duplex printing path 106 of FIG. 2) in combination with several print substrate rollers 326*a*, 326*b*, 326*c*, 326*d*, 326*e*. In general, the print substrate rollers 326*a*-326*e* are constructed with relatively high-friction surfaces which, when brought into contact with a print substrate, generate sufficient translational force to advance the print substrate along a desired path. The print substrate path 212 of FIG. 2 is defined by the platen 308.

As the print substrate is directed along the print substrate path 212, the print bar 210 forms an image by applying ink to a first side of the print substrate. The print substrate travels further along the platen 308 to a guide ramp 328 which, in combination with a diverter 329 of the duplexer 300, directs the print substrate upward toward the print substrate roller 326*a*. The print substrate roller 326*a* is a bi-directional roller and may turn in either direction. In the view of FIG. 3, the print substrate roller 326*a* turns clockwise (as illustrated in FIG. 3) to advance the print substrate toward an output path 214. If the print substrate is to have an image printed on the second side, the print substrate roller 326*a* reverses its direction of rotation to counter-clockwise such that after the print substrate passes the diverter 329, the print substrate is directed through the duplex path 306 adjacent a rear side of the diverter 329. The rollers 326*b*-326*d* contact the print substrate and advance the print substrate along the duplex path 306. The rollers are assisted in guiding the substrate adjacent the duplexer 300 by a substrate guide 332 in the example of FIG. 3. The example substrate guide 332 may be attached to the duplexer 300 or may be a separate structure in the printer. The example duplexer 300 of FIG. 3 also includes several star wheels 334 to guide the print substrate while reducing physical contact with the printed image.

As the print substrate traverses the duplex path 306, the print substrate roller 326*e* and/or another print substrate guide attached to the printer (not shown) directs the print substrate onto the platen 308 (e.g., back onto the substrate path 212) with the second side facing the print bar 210. Thus, the print bar 210 may form an image on the second side of the print substrate. After the print bar forms the image, the guide ramp 328 of the platen 308 again directs the print substrate toward the roller 326*a*. Since, in this example, both sides of the print substrate have been printed, the roller 326*a* rotates clockwise to direct the print substrate toward the output print substrate path 214. The print substrate continues along the output path 214 to an output tray and/or to further printing processes.

As illustrated in FIG. 3, the example housing 304 may include a removable cover 336 to facilitate removal of the spit roller sled 324 and/or access to the waste substance chamber 302 and/or the absorber 310. In some other examples, however, the cover 336 is not removable and is instead a part of the housing 304. The cover 336 contains ink aerosol in combination with the bulb seals 320 and 322 to reduce and/or prevent contamination of other portions of the printer 200.

Figure 6:
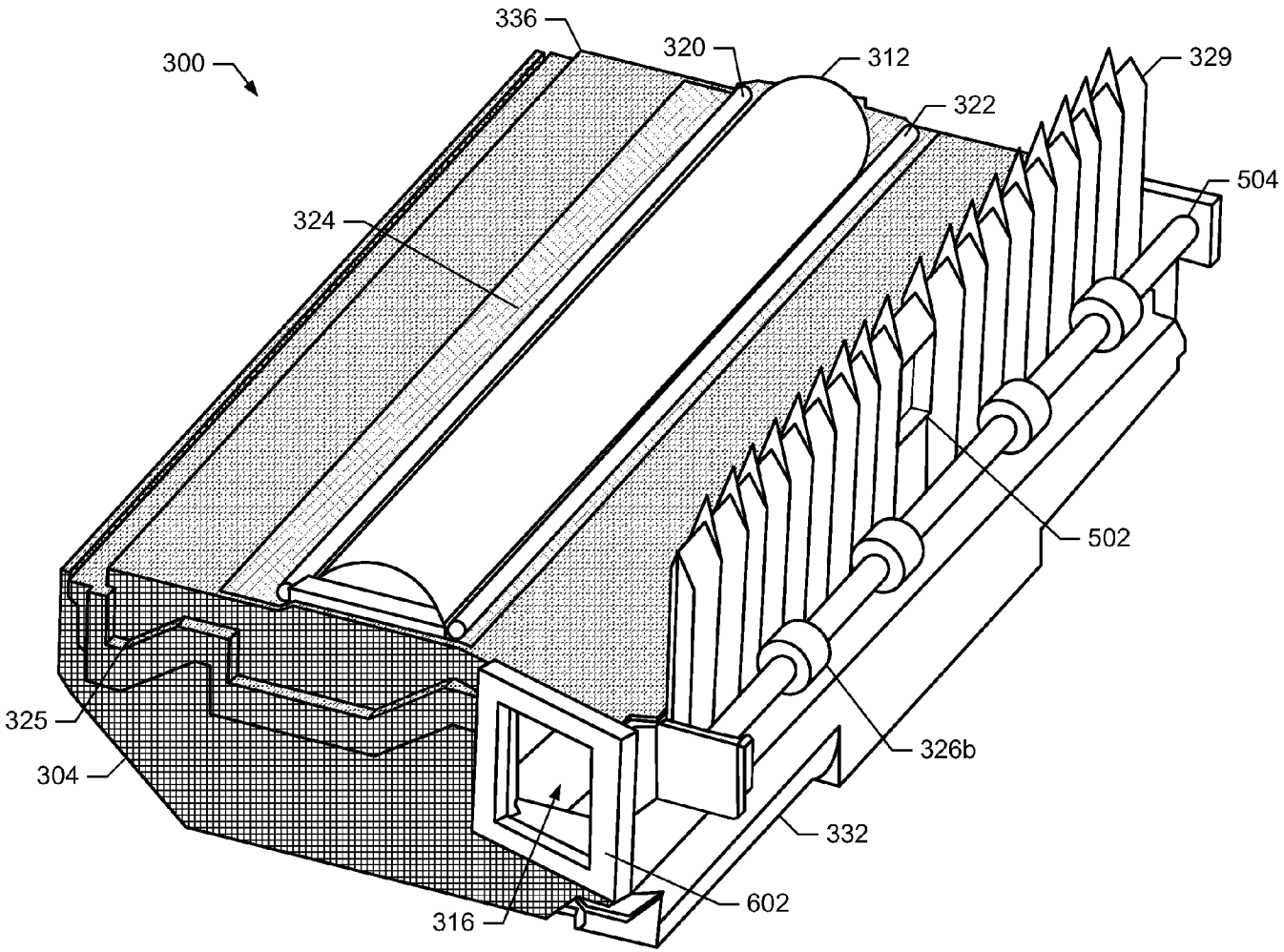
FIG. 6 is a perspective view of the example duplexer of FIGS. 3 and 4.

FIG. 4 is another schematic diagram of the example duplexer 300 of FIG. 3 but showing the duplexer 300 when uninstalled from a printer. As illustrated in FIG. 4, when the duplexer 300 is uninstalled, the spit roller sled 324 is retracted into the waste substance chamber 302 to protect the waste ink roller 312 from damage. The duplexer 300 may be removed to, for example, facilitate the removal of a paper jam from the printer and/or to refresh the duplexer 300 as explained below. Because the waste substance chamber 302 is located within the duplexer 300, the waste substance chamber 302 is removed with the duplexer 300 and does not require separate action to remove the waste substance chamber 320 to access the paper path. As illustrated in FIGS. 5 and 6, a thumb hole 502 may be provided in the duplexer 300 to facilitate removal of the duplexer 300.

The example spit roller sled 324, which supports the waste ink roller 312, the scraper 314, and the bulb seals 320 and 322, is coupled to the housing 304 in the track 325. The track 325 is oriented at an angle to translate horizontal movement (in the views of FIGS. 3 and 4) of the spit roller sled 324 into elevation of the sled 324. Thus, when the duplexer 300 is installed into the printer in a lateral installation direction 402, the spit roller sled 324 may contact a structure (e.g., a cover stop) on the printer that forces the spit roller sled 324 along the track 325 to the installed position illustrated in FIG. 3. Conversely, when the duplexer 300 is uninstalled from the printer, the spit roller sled 324 is allowed to travel along the track 325 to the uninstalled position illustrated in FIG. 4. To move the spit roller sled 324 to the retracted position of FIG. 4, the duplexer 300 may be provided with springs to urge the sled 324 to the retracted position.

While the example duplexer 300 of FIGS. 3 and 4 includes a retractable spit roller sled 324, the spit roller sled 324 may be stationary and/or may retract, rotate, lift, etc., in another direction and/or via another mechanism. The example retractable spit roller sled 324 of FIGS. 3 and 4 is to advantageously protect the waste ink roller 312 from damage when the duplexer 300 is uninstalled and facilitate installation and removal of the duplexer 300 to/from the printer. The illustrated spit roller sled 324 also provides access to the waste substance chamber 302, including the absorber 310, by retracting in a direction such that the absorber 310 is exposed and may be grasped for removal from the chamber 302.

In some examples, the spit roller sled 324 may be removed from the duplexer 300 to access the chamber 302 and/or the absorber 310. For example, when the duplexer 300 is in an uninstalled position (as illustrated in FIG. 4), one end of the sled 324 may be lifted through the illustrated opening 404 in the housing 304. When the end of the spit roller sled 324 is removed, the remainder of the spit roller sled 324 may be lifted from the housing 304 via the opening 404 because the sled 324 of FIGS. 3-6 is not attached to (e.g., may be separated from) the track 325. After removing the spit roller sled 324, the absorber 310 may be removed from the chamber 302 via the opening 404 in the housing 304. In some examples, the spit roller sled 324 may retract such that the absorber 310 may be accessed and removed via the opening 404 without removing the spit roller sled 324. Additionally or alternatively, the removable cover 336 may be removed from the housing 304 to enlarge the opening 404 through which the spit roller sled 324 may be removed.

FIG. 5 is a perspective view of the example duplexer 300 of FIG. 3. The duplexer 300 is shown in an installed position in FIG. 5. In particular, the waste substance chamber 302, the housing 304, the absorber 310, the waste ink roller 312, the aerosol collection chamber 316, the wall 318, the bulb seals 320 and 322, the spit roller sled 324, the diverter 329, and the substrate guide 332 are illustrated in more detail in FIG. 5.

An example thumb hole 502 is shown in FIG. 5. The thumb hole 502 may be used by a user of the printer to grip the duplexer 300 for installation and/or removal of the duplexer 300 into and/or from the printer. The example print substrate roller **326*b* is not illustrated in FIG. 5. However, a roller support 504 to support the print substrate roller 326*b* is shown in FIG. 5. The example duplexer 300 includes another roller support that is not illustrated in FIG. 5 to avoid obscuring other parts of the duplexer 300**.

As shown in FIG. 5, the example waste substance roller 312 includes an outer shell and several spokes connecting the shell to the axis. The roller 312 as illustrated in FIG. 5 has the advantage of being relatively lightweight and low-cost while being resistant to deformation. However, any other structural implementation may be used for the waste substance roller 312.

FIG. 6 is another perspective view of the example duplexer 300 of FIG. 3. The example duplexer 300 is illustrated in an installed position in FIG. 6. As illustrated in FIG. 6, the example duplexer 300 includes an aerosol filter port 602. The aerosol filter port 602 may be coupled to an aerosol filter and a vacuum source, which draws air including waste ink aerosol from the waste substance chamber 302 via the permeable wall 318 and the aerosol collection chamber 316.

Figure 7:
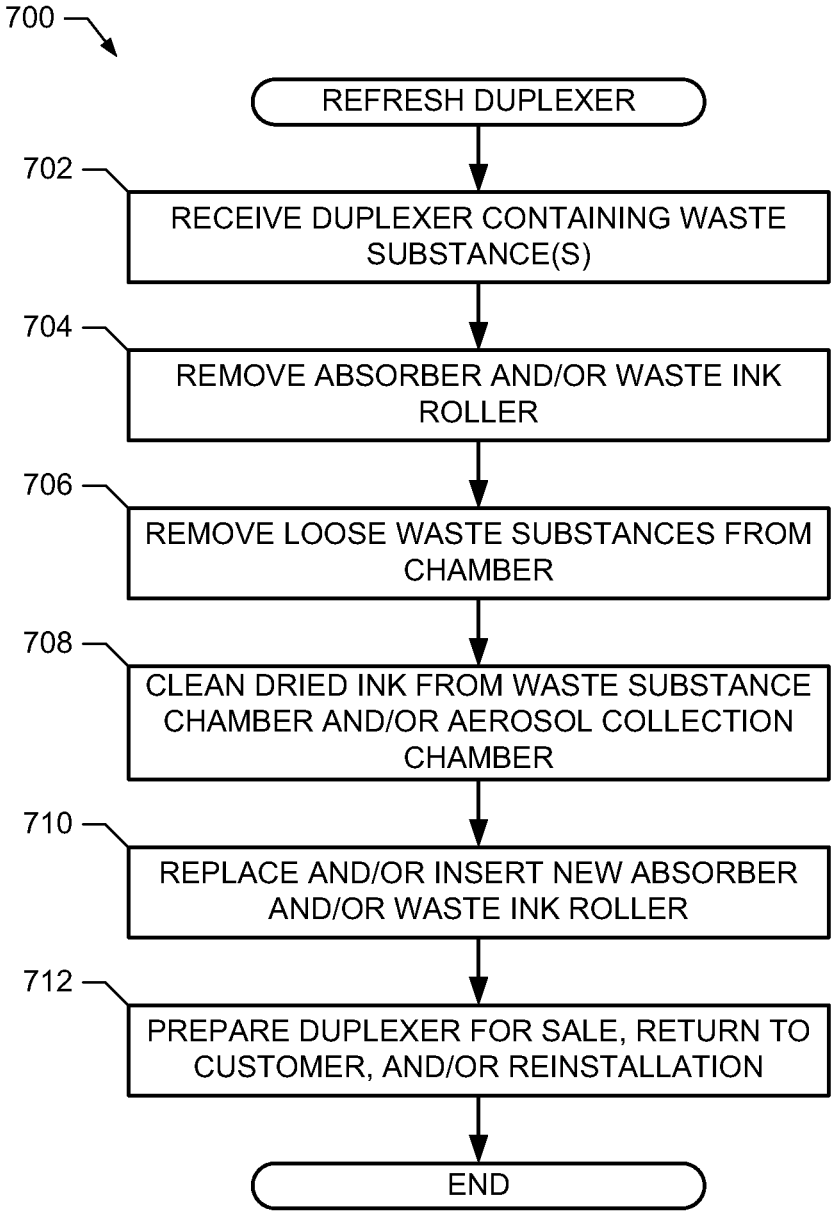
FIG. 7 is a flowchart illustrating an example method to refresh a duplexer in accordance with the teachings herein.

FIG. 7 is a flowchart illustrating an example method 700 to refresh a duplexer. While an example method 700 of refreshing a duplexer is illustrated in FIG. 7, one or more of the blocks illustrated in FIG. 7 may be added, combined, divided, re-arranged, omitted, eliminated and/or implemented in any other way. The example method 700 may be performed on a duplexer including a chamber (e.g., any of the duplexers of FIG. 1-6) by, for example, a manufacturer, a refurbisher, a repairer, a user and/or any other person or entity (any of which may be referred to as a "refresher") to extend the operating life of the duplexer.

The example method 700 begins when the refresher receives a duplexer (e.g., the duplexer 300 of FIG. 3) containing a waste substance (block 702). An example refresher may be a refurbisher who receives spent duplexers, removes waste from the same, and resells the refurbished duplexers. Thus, receiving the duplexer 300 may include, for example, receiving the duplexer 300 from a remote location and/or removing the duplexer 300 from a printer. The waste substance, such as waste ink, shipping fluid, and/or other waste substances generated by a printer, may be contained in the example waste substance chamber 302 and/or in the absorber 310 of FIG. 3. The refresher removes the absorber 310 and/or the waste ink roller 312 from the duplexer 300 (block 704). In some examples, the waste ink roller 312 and/or the removable cover 336 are removed to enable access to the absorber 310. In some other examples, however, the waste ink roller 312, the spit roller sled 324, and/or the removable cover 336 permit sufficient access (e.g., by retracting as shown in FIG. 4) to the absorber 310 and the waste substance chamber 302 to permit access to the absorber 310 when the duplexer 300 is uninstalled from the printer.

The refresher may also remove loose (e.g., unabsorbed) waste substances from the waste substance chamber 302 (block 706). For example, any waste ink or other substances not stored in the absorber 310 may be poured, wiped, and/or otherwise removed from the waste substance chamber 302. The refresher may then remove dried waste ink from the waste substance chamber 302 and/or the aerosol collection chamber 316 (block 708).

The refresher then replaces the absorber 310 and/or the waste ink roller 312, and/or may insert a new absorber 310 and/or a new waste ink roller 312 (block 710). For example, the refresher may insert a new absorber and/or partially or completely empty the absorber 310 and the waste ink roller 312 of waste substances and replace the emptied absorber 310 in the chamber 302. If the refresher did not remove the waste ink roller 312 (e.g., when performing block 704), the refresher does not replace or insert a new waste ink roller 312. The removable cover 336 may also be replaced (e.g., if the cover 336 was removed to access the absorber 310 and/or the chamber 302). The refresher then prepares the duplexer 300 for sale, for return to a customer, and/or for reinstallation in a printer (block 712). In some examples, the refresher may reinstall the duplexer 300 in a printer. In some other examples, the refresher may package a duplexer 300 for shipment and/or sale to a user of the printer to install the refreshed duplexer 300 in a printer. The example method 700 may then end or return to block 702 to refresh another duplexer.

From the foregoing, it will be appreciated that example printers and duplexers described above have internal waste substance chambers that have increased collection volumes when compared to known spittoons. Additionally, the example duplexers and integrated chambers may be removed as a unit by a user to access a paper jam and/or to refresh the duplexer. Thus, the duplexer may be inexpensively refreshed to extend an operating life of the duplexer. The example duplexers described above may also be modified to different scales and/or applied to different sizes and/or types of printers. The example duplexers and printers described above also reduce or eliminate the need for a separate shipping fluid collector by providing sufficient storage capacity to store the shipping fluid in addition to waste ink and/or other waste substances. Accordingly, example printers employing the example duplexers disclosed herein may be constructed and used more economically than known printers.

Although certain methods, apparatus, and articles of manufacture have been described herein, the scope of coverage of this patent is not limited thereto. To the contrary, this patent covers all methods, apparatus, and articles of manufacture falling within the scope of the appended claims.

What is claimed is:

1. A duplexer removably detachable for installation in a printer, the duplexer comprising:

a print substrate path to guide a print substrate; and a chamber encompassed within the duplexer to collect waste fluid.

2. A duplexer as defined in claim 1, further comprising a housing to define the print substrate path.

3. A duplexer as defined in claim 2, wherein the chamber is located within the housing.

4. A duplexer as defined in claim 1, further comprising an absorber located in the chamber, the absorber to store at least one of waste ink or a storage fluid.

5. A duplexer as defined in claim 1, further comprising an aerosol filter to filter aerosol particles from air within the chamber.

6. A duplexer as defined in claim 1, a roller to direct the waste fluid into the chamber.

7. A duplexer as defined in claim 6, wherein the roller is to retract at least partially into the chamber when the duplexer is not installed.

8. A duplexer as defined in claim 6, further comprising a scraper to remove the waste fluid from the roller.

9. A duplexer as defined in claim 1, further comprising a diverter to direct the print substrate along the print substrate path.

10. A method of transforming a duplexer from a first state to a second state, comprising:

receiving the duplexer encompassing a chamber containing a waste fluid;

removing the waste substance from the duplexer; and preparing the duplexer to be installed in a printer.

11. A method as defined in claim 10, wherein the duplexer comprises a chamber and the waste fluid is located within the chamber.

12. A method as defined in claim 11, wherein removing the waste fluid from the duplexer comprises removing an absorber from within the chamber.

13. A method as defined in claim 12, wherein preparing the duplexer to be installed in the printer comprises inserting a second absorber into the chamber.

14. A method as defined in claim 1, wherein preparing the duplexer to be installed in the printer comprises packaging the duplexer for sale.

15. A printer, comprising:

a duplexer defining a print substrate path to guide a print substrate and encompassing a chamber to collect waste fluid;

a print head to form an image on a print substrate and to eject waste ink into the chamber; and a roller to advance the print substrate along the print substrate path through the printer.

16. A printer as defined in claim 15, wherein the duplexer is removable from the printer.

17. A printer as defined in claim 15, wherein the duplexer comprises an absorber to store at least one of the waste ink or a storage fluid.

18. A printer as defined in claim 15, wherein the roller defines the print substrate path.

19. A printer as defined in claim 18, wherein the duplexer comprises a housing to cooperate with the roller to define the print substrate path.

20. A printer as defined in claim 19, further comprising a platen located between the print head and the duplexer to define a portion of the print substrate path.

* * * * *